US005606351A

United States Patent [19]

Hawkins

[11] Patent Number: 5,606,351

[45] Date of Patent: Feb. 25, 1997

[54] ALTERING THE INTENSITY OF THE COLOR OF INK JET DROPLETS

[75] Inventor: Gilbert A. Hawkins, Mendon, N.Y.

[73] Assignee: Eastman Kodak Company, Rochester, N.Y.

[21] Appl. No.: 262,414

[22] Filed: Jun. 20, 1994

[51] Int. Cl.[6] ..... B41J 2/205; B41J 2/015; B41J 2/175

[52] U.S. Cl. ..... 347/15; 347/20; 347/85

[58] Field of Search ..... 347/15, 48, 6, 347/43, 98, 95

[56] References Cited

U.S. PATENT DOCUMENTS

| | | | |
|---|---|---|---|
| 4,432,003 | 2/1984 | Barbero et al. | 346/140 R |
| 4,494,128 | 1/1985 | Vaught | 347/15 |
| 4,503,444 | 3/1985 | Tacklind | 346/140 R |
| 4,614,953 | 9/1986 | Lapeyre | 347/43 |
| 4,631,548 | 12/1986 | Milbrandt | 346/1.1 |
| 4,884,595 | 11/1989 | Trueba et al. | 346/140 R |
| 5,221,934 | 6/1993 | Long | 346/140 R |
| 5,371,529 | 12/1994 | Guchi et al. | 347/95 X |

FOREIGN PATENT DOCUMENTS 0468075 7/1990 European Pat. Off. .

*Primary Examiner*—Benjamin R. Fuller
*Assistant Examiner*—Juanita Stephens
*Attorney, Agent, or Firm*—Raymond L. Owens

[57] ABSTRACT

The chemical composition of each ejected droplet in an ink jet can be controlled so as to alter the color or color intensity of the droplet and thereby effect deposition of continuous-tone color images on suitable receiving media.

6 Claims, 3 Drawing Sheets

ALTERING THE INTENSITY OF THE COLOR OF INK JET DROPLETS

FIELD OF THE INVENTION

The present invention relates to ink jet printing and, more particularly, to an ink jet print head which expels a drop or drops of ink having a controlled composition as a result of the mixing of two or more fluid constituents.

BACKGROUND OF THE INVENTION

The term "ink jet" as used herein is intended to include all drop on demand ink jet propulsion systems, including, but not limited to, "bubble jet," "thermal ink jet," and piezoelectric.

Drop on demand thermal ink jet printers operate by rapidly heating a small volume of ink, causing it to vaporize and expand, thereby ejecting ink through an orifice or nozzle and causing it to land on selected areas of a receiving medium. The sequenced operation of an array of such orifices moving past a receiver writes a dot pattern of ink on the receiver, forming text or pictorial images. The print head typically includes an ink reservoir and channels to replenish the ink to the region in which vaporization occurs. An arrangement of thermal ink jet heaters, ink channels, and nozzles is disclosed in U.S. Pat. No. 4,882,595. Also known is an ink jet printing device which electrically generates an agitated condition between an electrode and a counter electrode, which in turn causes ink particles to be emitted through the nozzle. (U.S. Pat. No. 4,432,003). Another class of devices use a separate piezoelectric transducer to expel the drops. Color rendition is accomplished by adding a few (typically three) color ink reservoirs and associated nozzles and ejection means so that dots of different colors may be overlaid on an appropriate receiver.

Although the drop on demand printers are efficient and inexpensive, the images they produce are in general binary in the sense that the size of the drops of ink cannot be much varied and the number of colors available for each drop is small, being that of the number of associated ink reservoirs and nozzle sets. While European Pat. No 0 468 075 teaches the use of multiple resistive heater elements with voltage pulses tailored to control droplet volume, the variation in volume is not optimally large. Also, variation of the area of the dots on the receiving medium, which results from droplet volume variation, is not an optimal method for producing a continuous tone image, compared with variation of color intensity within dots of constant area.

While multilevel black and white or multilevel color dots can be achieved by multiply depositing a variable number of identical drops of ink in the same spatial location, this greatly slows the operation of the printer because the frequency of operation of the droplet ejection process is limited. For example, U.S. Pat. No. 4,631,548 teaches a method of multiple droplet deposition in which the diameter of the matrix dot formed on the recording media is held nearly constant. Similarly, halftoning may be practiced, as is well known in the printing industry, but the required number of nozzles is then very large and/or the printing speed is again substantially reduced.

It is thus desirable to control the intensity of the color droplets or of the black ink droplets produced in order to render superior image quality while maintaining machine productivity. Some techniques to accomplish this objective have been previously disclosed. U.S. Pat. No. 5,221,934 teaches a method for electrochemical resistive ink jet printing comprising a solvent and a leuco dye in which the passage of a variable current through a leuco dye produces an ink of variable density. Also U.S. Pat. No. 4,503,444 teaches an operational mode of thermal ink jet printing in which the amount of ink in a droplet may be controlled by formation of the droplet from the coalescence of many smaller droplets emitted at very high repetition rates. These methods require either specialized inks or specialized operating conditions, and may produce dots of varying sizes rather than the more desirable case of dots of constant size but varying color intensity.

SUMMARY OF THE INVENTION

It is the object of this invention to provide an improved ink jet printing head which can place colored patterns of dots of varying intensities on a receiver while maintaining the dot size nearly constant.

This object is accomplished by a drop on demand ink jet printhead having the capability of mixing two or more fluid components in a controlled manner so as to alter the composition of each ejected droplet without altering its size comprising:

(a) two or more fluid reservoirs for containing fluids in preparation for printing;

(b) means for defining an ink chamber for receiving fluid components from the reservoirs for containing a quantity of fluid in preparation for expulsion;

(c) means for defining ink jet channels respectively connected to the reservoirs to deliver fluid components from the reservoirs to the chamber during chamber refill;

(d) means for causing the expulsion of a drop of fluid from the chamber; and (e) means for changing the ratios of the volumes of the two or more fluid components that refill the chamber subsequent to the expulsion of the drop.

A feature of this invention is the ability to provide a continuous tone scale for black and white and color images achieved by ink mixing. The advantages include improvement in color rendition of pictorial images and in the rendition of black and white text and images, particularly in regions of the images in which color density is low, and improvement in the speed of printing which may be achieved for a given image quality. It is also advantageous in that mixing of dyes or pigments occurs in the fluid state so that pigments and dyes are fully dispersed before application to the receiver. It is also an advantage that any chemical reactions of the fluids so mixed occur in the print head and not on the receiving medium itself, thus affording greater variability in the nature and type of receivers which may be substituted in the process and greater variability in the nature and type of fluids whose mixing effects modulation of color intensity.

It is also a feature of this invention to provide a process for the fabrication of an improved ink jet head that can be realized with a minimum of changes to fabrication steps well established in the art.

It is another feature to establish a method of fluid mixing of two or more fluid components drawn from reservoirs in a controlled manner so as to achieve a continuous variability of the chemical properties of the mixture on a size scale consistent with that known in the art of printhead technologies, namely of channels of from 2 to 50 micrometers width.

DESCRIPTION OF THE PREFERRED EMBODIMENT

Figure 1:
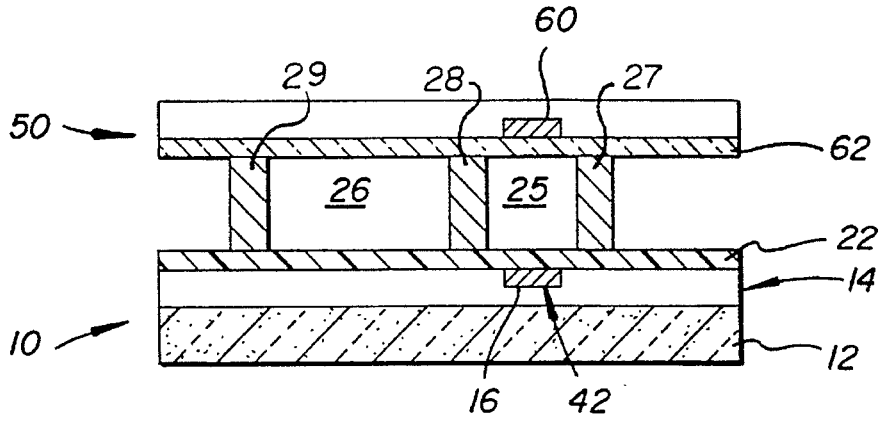
FIG. 1 is a preferred embodiment of the reservoir, channel, and chamber structures of an ink jet head of the resistive type in accordance with this invention, shown in cross-section along the lines marked A in FIG. 2.
Figure 2:
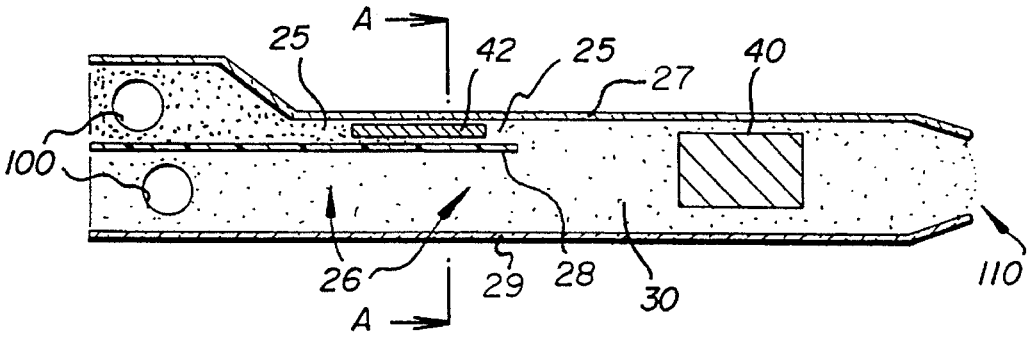
FIG. 2 shows a top view of FIG. 1 in accordance with this invention.

Referring to FIG. 1, an ink jet printhead base 10 includes a silicon substrate 12 upon which is grown a layer of silicon dioxide 14, preferably in the thickness range of from 0.2 to 4 microns, thinned regions 16 of which have been rendered thinner than the original layer by photolithographic definition of openings in photoresist in thinned regions 16 followed by partial etching of the silicon dioxide in these regions and removal of the photoresist, as is commonly practiced in the art of silicon device manufacturing. Resistive element(s) 40 (FIG. 2) and 42 (FIG. 1) are made as follows. A bilayer of metal (not shown), preferably having a thinner layer of a restive material such as $HfB_2$ of thickness in the range of from 500 to 2000 Angstroms over which is deposited a layer of aluminum or aluminum copper alloy of thickness in the range of from 0.2 to 2.0 micrometers is deposited and photolithographically defined by methods well known in the manufacture of resistive printheads to provide thermal resistive element(s) 40 and 42 positioned as shown in FIG. 2 with respect to thinned regions 16 and ink refill channel(s) 25 and 26. The thermal resistive element(s) 40 and 42 are regions of the bilayer in which the top metallic layer has been removed by etching. Further, as shown in FIG. 1, dielectric layer 22 of thickness preferably in the range of from 0.2 to 2.0 micron of silicon dioxide or silicon nitride or a mixture of both is deposited over the resistive elements and electrical leads as a thermal barrier and corrosion protection layer, as is commonly practiced in the art. Dielectric layer 22 in the vicinity of thinned regions 16 may be optionally thinned to thickness in the range of from 0 to 0.5 micron to reduce the thermal time constant of the resistive elements 42 in these regions.

The walls 27, 28 and 29 of ink refill channel(s) 25 and 26 are constructed preferably of a insulative polymer such as VACREL (made by dupont) by means of photolithography and etching as is well known in the art. The placement and size of these walls is such as to define a narrow refill channel 25 and wider ink refill channel 26 both of which communicate or connect with the ink chamber 30 in a manner such that during refill of ink chamber 30 some fluid is drawn for the purpose of refill from each channel, the amounts of the fluids so drawn being dependent on the geometry of the channels and the viscosity of the fluids as is well known in the art.

A top plate 50 (FIG. 1) fabricated in a manner similar to base 10 is provided dn its bottom side with further resistive electrode elements 60 and serves the dual purpose of providing a physical ceiling for the ink channels and chambers as well as providing additional electrode elements for the application of heat and/or electric fields to said channels. Additionally, an electric field may be applied to ink refill channel 25 by imposition of a voltage difference between resistive electrode elements 60 and resistive elements 42.

The top plate 50 with optional resistive electrode elements 60 and passivation layer 62 is fabricated in a manner similar to base 10 except that the top plate is constructed from a glass substrate rather than silicon and contains openings 100 (FIG. 2) which communicate with liquid from fluid reservoirs (not shown) as is now practiced in the art. The nozzle region 110 for drop ejection in this preferred embodiment lies just to the right of resistive element 40 at the termination point of the channel, base, and top, and may or may not be polished and surface treated to ensure smoothness, as is common in the art for fabrication of such devices.

Figure 3:
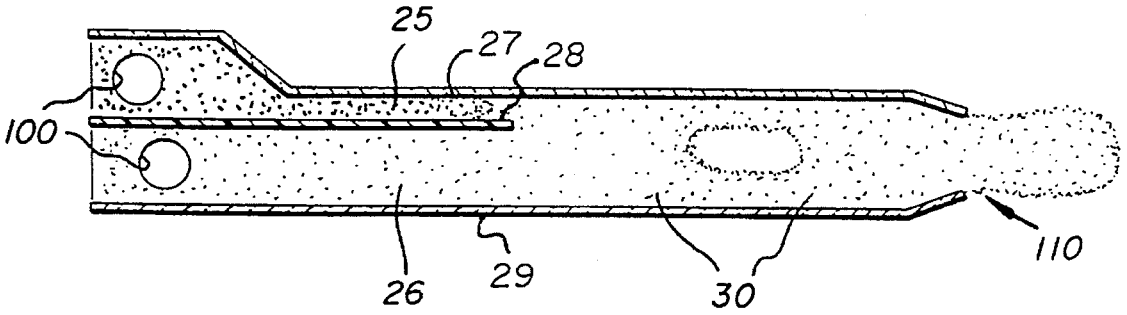
FIG. 3 shows a top view of the ink jet head of FIG. 1 shortly after activation of the drop expulsion resistor.

The operation of the device is illustrated in FIGS. 3 to 6 which show a time sequence of bubble creation, droplet ejection, and initiation and completion of refill, respectively. In FIG. 3, the bubble is shown schematically in its initial stages to have initiated expulsion of ink out nozzle region 110. Bubble formation also creates a pressure backwave which is partially damped in ink refill channel(s) 25 and 26 in accordance with the geometry of the channels and the viscosity of the fluids.

Figure 4:
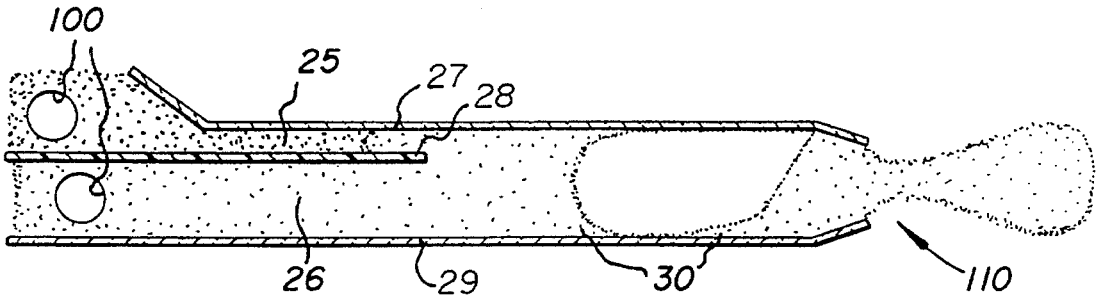
FIG. 4 shows a top view of the ink jet head of FIG. 1 at the moment of drop ejection.
Figure 5:
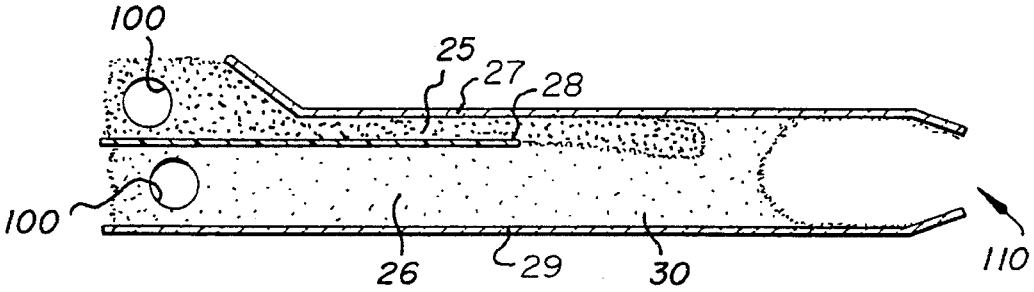
FIG. 5 shows a top view of the ink jet head of FIG. 1 at the onset of the refill cycle in accordance with this invention.

FIG. 4 depicts drop ejection and the initiation of the chamber refill, critical to the practice of the present invention. During the refill sequence in conventional printheads, a non-cavitating fluid column is drawn by capillary action into the chamber region, from the ink refill channel, as is well known in the prior art of printhead technology. In the preferred embodiment shown in FIG. 4, the fluid drawn into the chamber comes from two refill channels, primary ink refill channels 26 and smaller ink refill channel 25, each containing chemically different fluids, depicted in FIG. 4 by different shadings, which mix together in ink chamber 30. In one embodiment, the difference in the fluids is one of color. In a second preferred embodiment, the difference in the fluids is associated with the concentration of dyes or pigments. In a third preferred embodiment, the two fluids react chemically to produce a dye. In a fourth preferred embodiment, the two fluids react chemically to beach a dye. It is common to all embodiments that the color or color intensity properties of the mixture continuously change with and are dependent on the relative volumes of the fluids so mixed.

In the situation depicted in FIG. 4, resistive elements 42 (shown in FIG. 1) has been activated by the application of current through the resistive element by current means (not shown) at the onset of fluid refill, so as to increase the temperature of the fluid in ink refill channel 25 relative to the temperature the in absence of heater activation. In the preferred embodiment, the resistive elements 42 in ink refill channel 25 is activated similarly to the operation of resistive element 40 in ink chamber 30 but with a lesser voltage or lesser duration or both, so that no bubble forms in ink refill channel 25, the effect of resistive elements 42 therefore being primarily to heat the fluid in ink refill channel 25 locally.

The amount of fluid withdrawn from ink refill channel 25 is increased by application of heat from resistive elements 42, such heat being conducted through dielectric layer 22, which heat lowers the viscosity of fluid in ink refill channel 25, as is known in fluid mechanics by observation of fluid flows in restricted geometries. The amount of fluid withdrawn from ink refill channel 25 can in general be selectively modulated from drop to drop by application of varying amounts of heat from resistive elements 42.

Figure 6:
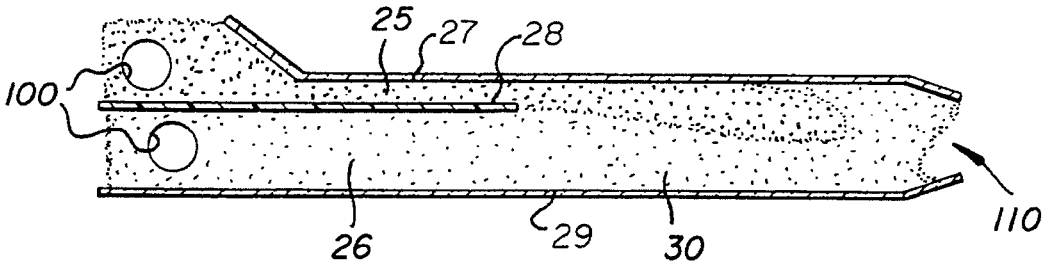
FIG. 6 shows a top view of the device of FIG. 1 after refill is complete.

FIG. 6 shows the device of FIG. 3 at the end of the refill cycle. In accordance with this invention, the composition of the fluid in the chamber now will involve additional amounts of the type of fluid in ink refill channel 25, there having been more such fluid drawn from heated ink refill channel 25 then would ordinarily have been drawn during fluid refill with ink refill channel 25 not heated.

Figure 7:
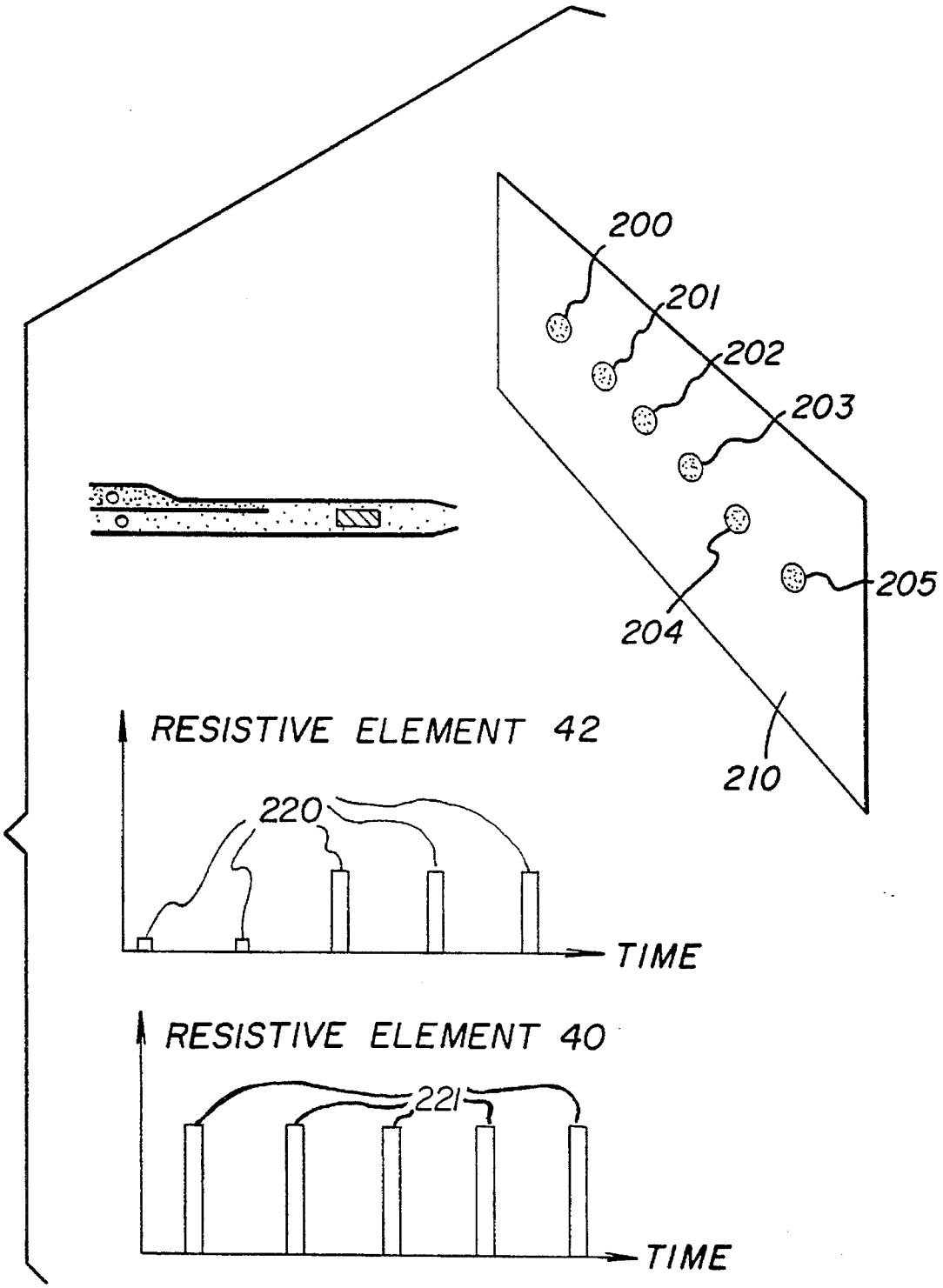
FIG. 7 shows regions on an appropriate receiver in which ink droplets of constant size but with varying compositions have been deposited, resulting in an array of continuous tone dots of constant size as taught by this invention. Also shown are the electrical waveforms of the voltages applied to the resistive elements of the printhead.

FIG. 7 shows droplets 200–205 deposited, one after the other, during five consecutive ejection/refill cycles in accordance with this invention onto an appropriate receiver 210. In response to an increase in the amount of heat applied by resistive elements 42 during refill cycles 2 through 4, the composition of droplets 203 through 205 shifts toward a greater proportion of fluid of the type contained in ink refill channel 25 as a fraction of total fluid. The increase in the amount of heat provided by resistive elements 42 is caused as shown in FIG. 7, by the increase in voltage amplitude of electrical pulses 220 which activate resistive elements 42. Also shown are voltage pulses 221 applied to primary resistive element 40 to illustrate the preferred timing of the pulses. The gradual change in droplet composition is illustrated in FIG. 7 along side each of the deposited droplets. A gradual change in composition is seen to be the response to the sudden change in pulse amplitude, as is characteristic of the practice of this invention.

The exact nature of the change is determined by the detailed geometry of the ink refill channel(s) 25 and 26, resistive elements 42, thinned regions 16, ink chamber 30, and nozzle region 110. As is practiced in the art, electronic means, such as look up tables and data pipeline means, can be used to anticipate the composition needed in imaging and to time the initiation of electrical pulses 220 to optimize the time of occurrence of the composition change of the ejected droplets, thus minimizing the effects of the response time of the printhead on the printed image.

It is to be appreciated that the design and manufacture of the printhead described in accordance with this invention may be subject to many modifications of materials, channel geometries, and methods of operation as are commonly practiced in the industry. For example, the materials of the channel walls, while preferably insulative, may be made of metallic materials. Likewise, the geometrical layout of the multiple channels refilling a single chamber, while described for the channel geometry in which ejection occurs in a direction parallel to the ink refill channels, may also be achieved in devices ejecting droplets perpendicular to the channel length, as is common in the art. Moreover, the method of operation of the printhead may include modulation of the properties of the fluid in the channels over a wide range, not limited to heating alone but including the possibility of phase changes of the fluid media in association with refill in one or more of the fluid channels. Likewise, structures other than the application of heat alone may be employed by the device described to modulate fluid flow. For example, simultaneous application of both heat and electric field to accomplish modulation of fluid flow in one or more channels relative to other channels cannot be excluded as an embodiment for fluids whose viscous properties change with both temperature and electric field. Likewise, the methods practiced in the art for applying voltage pulses of various shapes, amplitudes, and durations are also possible in light of the above teachings, as are methods for processing the raw image data to optimize the images printed by a particular head geometry.

The invention has been described in detail with particular reference to certain preferred embodiments thereof, but it will be understood that variations and modifications can be effected within the spirit and scope of the invention.

PARTS LIST 10 base
12 silicon substrate
14 silicon dioxide layer
16 thinned regions
22 dielectric layer
25 ink refill channel
26 ink refill channel
27 walls
28 walls
29 walls
30 ink chamber
40 resistive element
42 resistive elements
50 top plate
60 resistive electrode elements
62 passivation layer
100 openings
110 nozzle region
200 droplets
201 droplets
202 droplets
203 droplets
204 droplets
205 droplets
210 receiver
220 electrical pulses
221 voltage pulses

What is claimed is:

1. A drop on demand ink refill printhead for ejecting ink droplets having a capability of mixing two or more fluid components in a controlled manner so as to alter chemical composition of each ejected droplet without altering size of the ejected droplet comprising:

(a) two or more ink refill channels for containing fluids in preparation for printing;

(b) means for defining an ink chamber for receiving the fluid components from the ink refill channels for containing a quantity of fluid in preparation for expulsion;

(c) means for connecting the ink refill channels to the chamber to deliver the fluid components from the ink refill channels to the chamber during chamber refill;

(d) means for causing expulsion of a drop of fluid from said chamber; and (e) means for changing ratios of volumes of the two or more fluid components that refill said chamber subsequent to the expulsion of said drop, including means for heating the fluid in the ink refill channel connecting one or more of a ink refill channels to the chamber thereby altering the viscosity of the fluid component as the fluid flows to the chamber.

2. A method of controlling composition of an ejected droplet in an ink refill print head by mixing of two or more fluids during refill cycle of device operation, the method comprising the steps of:

(a) juxtaposing two ink refill channels and connecting the ink refill channels to a common mixing chamber through which ink refill channels fluid components are drawn by capillary or pressure induced action to the chamber whenever an amount of fluid in the chamber is caused to be reduced from an amount which accumulates in time;

(b) independently altering viscosities of one fluid component or of both the fluid components in the ink refill channels; and (c) causing capillary or pressure induced flow of the fluid components in the chamber.

3. The invention of claim 2 selectively applying heat to one or more of the ink refill channels through which fluid is drawn to the mixing chamber in order to selectively control flow rate of the fluid.

4. The invention of claim 2 selectively applying an electric field to one or more of the ink refill channels through which a fluid component is drawn to the mixing chamber in order to selectively control flow rate of the fluid components in that channel or channels.

5. The invention of claim 2 including applying both heat and an electric field to one or more of the ink refill channels through which fluid is drawn to the mixing chamber in order to selectively control flow rate of the fluid components in that channel or channels.

6. A drop on demand ink refill printhead for ejecting ink droplet having a capability of mixing two or more fluid components in a controlled manner so as to alter chemical composition of each ejected droplet without altering size of the ejected droplet comprising:

(a) two or more ink refill channels for containing fluids in preparation for printing;

(b) means for defining an ink chamber for receiving fluid components from the ink refill channels for containing a quantity of fluid in preparation for expulsion;

(c) means for connecting the ink refill channels to the chamber to deliver fluid components from the ink refill channels to the chamber during chamber refill;

(d) means for causing expulsion of a drop of fluid from said chamber; and (e) means for changing ratios of volumes of the two or more fluid components that refill said chamber subsequent to the expulsion of said drop, including means for applying an electric field across a fluid component in one or more of said ink refill channels, thereby altering viscosity of the fluid component as the fluid flows to the chamber.

* * * * *

UNITED STATES PATENT AND TRADEMARK OFFICE

CERTIFICATE OF CORRECTION

PATENT NO. : 5,606,351

DATED : February 25, 1997

INVENTOR(S) : Gilbert A. Hawkins

It is certified that error appears in the above-indentified patent and that said Letters Patent is hereby corrected as shown below:

Column 7, line 14 after "fluid" please insert --in one or more of said channels

Column 7, line 19 delete "in that channel or channels" and insert --in one or more of said channels Column 7, line 24 delete "that channel or channels" and insert --one or more of said channels--

Signed and Sealed this

Sixteenth Day of September, 1997

*Attest:*

*Attesting Officer*

Bruce Lehman

BRUCE LEHMAN

*Commissioner of Patents and Trademarks*